US005099439A

United States Patent [19]

Saito

[11] Patent Number: 5,099,439

[45] Date of Patent: Mar. 24, 1992

[54] SELF-DIAGNOSABLE FUEL-PURGING SYSTEM USED FOR FUEL PROCESSING SYSTEM

[75] Inventor: Chiaki Saito, Kanagawa, Japan

[73] Assignee: Nissan Motor Company, Limited, Yokohama, Japan

[21] Appl. No.: 541,983

[22] Filed: Jun. 22, 1990

[30] Foreign Application Priority Data

Jun. 26, 1989 [JP] Japan ..... 1-160634

[51] Int. Cl.[5] ..... F02M 39/00

[52] U.S. Cl. ..... 364/551.01; 364/424.03; 123/520

[58] Field of Search ..... 364/551.01, 550, 424.03, 364/431.01, 431.05, 431.09; 73/117.2, 118.1, 119 R; 123/518, 519, 520, 440, 198 D

[56] References Cited

U.S. PATENT DOCUMENTS 4,646,702 3/1987 Matsubara et al. ..... 123/520
4,741,318 5/1988 Kortge et al. ..... 123/520
4,867,126 9/1989 Yonekawa et al. ..... 123/520
4,962,744 10/1990 Uranishi et al. ..... 123/519

*Primary Examiner*—Parshotam S. Lall
*Assistant Examiner*—Michael Zanelli
*Attorney, Agent, or Firm*—Foley & Lardner

[57] ABSTRACT

A self-diagnosable fuel-purging system used for a fuel processing system causes a fuel to be introduced into a canister packed with an adsorbent, such as activated carbon, onto which the introduced fuel is adsorbed, and causes the adsorbed fuel to be introduced into an engine when a negative pressure greater than a predetermined value is produced in an intake manifold upstream of a throttle valve. The fuel-purging system includes discriminating means for determining whether or not the fuel-purging system itself is normal on the basis of output signals representative of an air/fuel ratio in an exhaust gas from the engine and a temperature in the canister. The discriminating means determines abnormality of the fuel-purging system when both of the temperature in the canister and the air/fuel ratio are substantially constant while a fuel-purging condition, in which the fuel adsorbed onto the adsorbent in the canister is supplied to the engine, is detected.

10 Claims, 1 Drawing Sheet

SELF-DIAGNOSABLE FUEL-PURGING SYSTEM USED FOR FUEL PROCESSING SYSTEM

BACKGROUND OF THE INVENTION

1. Field of The Invention

The present invention relates generally to a fuel-purging system used for a fuel processing system which processes vaporized fuel in a fuel tank before the fuel is introduced into an internal combustion engine for automotive vehicles. More specifically, the invention relates to a self-diagnosable fuel-purging system which can detect abnormality in itself.

2. Description of The Background Art

Conventionally, in fuel-purging systems used for fuel processing systems which process vaporized fuel within a fuel tank, when the pressure within the fuel tank reaches a positive pressure greater than a predetermined value, the vaporized fuel within the fuel tank is introduced into a canister to be collected therein, and then the fuel collected in the canister is supplied to an engine through a purging passage.

The purging passage is provided with a diaphragm valve controlled to be opened and closed in accordance with negative throttle pressure. The diaphragm valve is suitably controlled so that fuel-purging may be performed.

When the engine is driven in an idling condition, or stopped, the diaphragm valve is caused to close so that purged fuel is prevented from being supplied to the engine. In this way, the air/fuel ratio of exhaust gas from the engine is prevented from becoming too rich, so that, for example, starting operation of the engine becomes impaired. Such a condition will be hereinafter referred to as "fuel-purging prevented condition". Such a system is described in Japanese patent Second (examined) Publication (Tokko Sho.) No. 53-19729.

However, the aforementioned conventional fuel-purging system does not have a system or program for determining whether or not the fuel-purging system is functioning normally, and can not detect abnormality in the fuel-purging operation itself.

SUMMARY OF THE INVENTION

It is therefore a principal object of the present invention to provide a self-diagnosable fuel-purging system which can detect abnormality of the fuel-purging system itself.

In order to accomplish the aforementioned and other objects, a fuel-purging system used for a fuel processing system utilizes discriminating means for determining whether or not the fuel-purging system itself is normal on the basis of sensed signals representative of an air/fuel ratio in an exhaust gas from an engine, and a temperature in a canister provided between a fuel tank and the engine. The discriminating means may determine abnormality of the fuel-purging system when both of the temperature in the canister and the air/fuel ratio are substantially constant while a fuel-purging condition, in which the fuel collected in the canister can be supplied to the engine, is detected.

According to one aspect of the present invention, a diagnosing system for a fuel-purging system which causes a fuel to be introduced from a fuel tank into a canister packed with an adsorbent for adsorbing the fuel thereon, and causes the fuel adsorbed onto the adsorbent to be introduced into an engine, comprises:

first detecting means for detecting a fuel purging condition in which the fuel adsorbed onto the adsorbent of the canister is supplied to the engine;

second detecting means for monitoring an air/fuel ratio in an exhaust gas from the engine to produce a first signal representative of the air/fuel ratio;

third detecting means for monitoring temperature in the canister; and discriminating means for determining abnormality of the fuel-purging system on the basis of the first and second signals when the fuel-purging condition is detected.

The discriminating means may determine abnormality of the fuel-purging system when both of the temperature in the canister and the air/fuel ratio are substantially constant while the fuel-purging condition is detected. The purging system may include a first fluid passage for establishing a first fluid communication between the canister and an intake manifold downstream of a throttle valve, a second fluid passage for establishing a second fluid communication between the canister and the intake manifold upstream of the throttle valve, and a first valve for being selectively open and closed to establish and block the first and second fluid communications. The first detecting means may detect the fuel-purging condition when the first valve is open.

The purging system may also include a first fluid passage for establishing a first fluid communication between the canister and an intake manifold downstream of a throttle valve, a second fluid passage for establishing a second fluid communication between the canister and the intake manifold upstream of the throttle valve, a first valve for being selectively open and closed to establish and block the first and second fluid communications, and a second valve provided in the second fluid passage for being selectively open and closed to establish and block the second fluid communication, the first valve being open when a negative pressure greater than a predetermined value is produced in the intake manifold upstream of the throttle valve, and the second valve being turned on to be open synchronously with the first valve. The first detecting means may detect the fuel-purging condition in response to turning ON of the second valve.

According to another aspect of the present invention, a fuel-purging system used for a fuel processing system for processing a fuel introduced into an engine, comprises:

a canister which communicates with a fuel tank, and into which a fuel is introduced from the fuel tank, the canister being packed with an adsorbent for adsorbing the fuel thereon;

a first fluid passage for establishing a first fluid communication between the canister and an intake manifold downstream of a throttle valve;

a second fluid passage for establishing a second fluid communication between the canister and the intake manifold upstream of the throttle valve;

a first valve for being selectively open and closed to establish and block the first and second fluid communication;

first detecting means for detecting a fuel purging condition in which the fuel adsorbed onto the adsorbent of the canister is supplied to the engine;

second detecting means for monitoring an air/fuel ratio in an exhaust gas from the engine to produce a first signal representative of the air/fuel ratio;

third detecting means for monitoring temperature in the canister; and discriminating means for determining abnormality of the fuel-purging system on the basis of the first and second signal values when the fuel-purging condition is detected by means of the first detecting means.

The discriminating means may determine abnormality of the fuel-purging system when both of the temperature in the canister and the air/fuel ratio are substantially constant while the fuel-purging condition is detected. The fuel-purging system may further comprise a second valve provided in the second fluid passage for being selectively open and closed to establish and block the second fluid communication. The first valve may be open when a negative pressure greater than a predetermined value is produced in the intake manifold upstream of the throttle valve, and the second valve may be turned on to be open synchronously with the first valve. The first detecting means may detect the fuel-purging condition in response to turning ON of the second valve.

BRIEF DESCRIPTION OF THE DRAWINGS

The present invention will be understood more fully from the detailed description given herebelow and from the accompanying drawings of the preferred embodiment of the invention. However, the drawings are not intended to imply limitation of the invention but are for explanation and understanding only.

In the drawings.

DESCRIPTION OF THE PREFERRED EMBODIMENT

Figure 1:
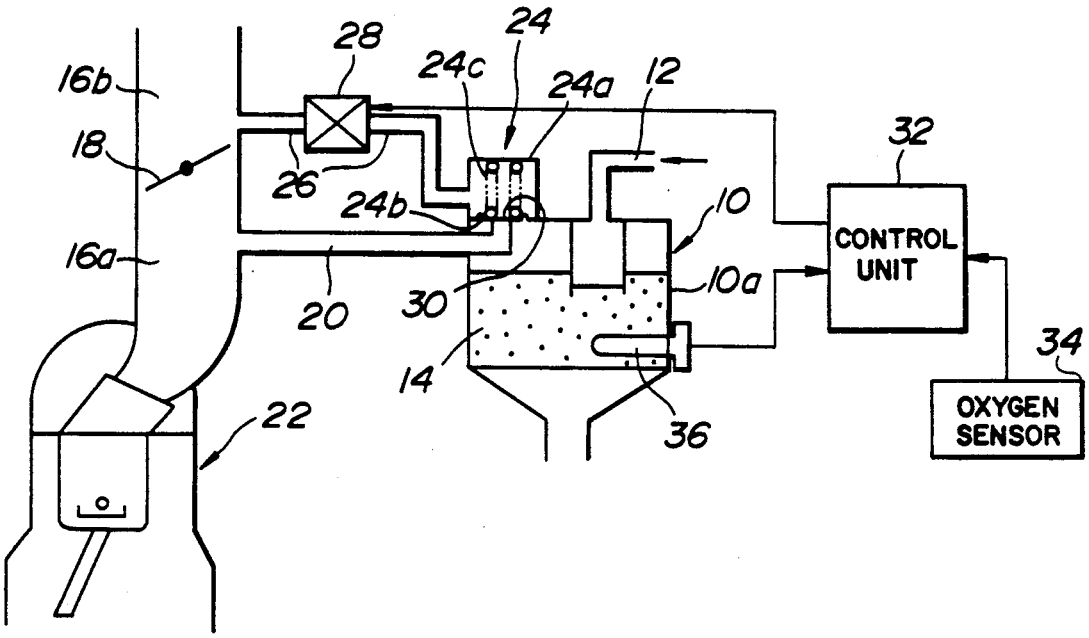
FIG. 1 is a schematic diagram of a fuel-purging system according to the present invention.

Referring now to the drawings, particularly to FIG. 1, a canister 10 has a canister body 10*a* which communicates with a fuel tank (not shown) via a pipe 12. The canister body 10*a* is packed with an adsorbent 14, such as an activated carbon, onto which vaporized fuel introduced to the canister body 10*a* is adsorbed. The canister 10 also communicates with an intake passage 16*a* downstream of an intake throttle valve 18 via a purging passage 20, so that the fuel passing through the canister 10 is introduced into an engine 22 via the purging passage 20 and the downstream intake passage 16*a*.

A diaphragm valve 24 is arranged between the canister 10 and the purging passage 20. The diaphragm valve 24 is controlled to be opened and closed by negative throttle pressure so as to establish and block communication between the canister 10 and the downstream intake passage 16*a*.

The diaphragm valve 24 comprises a valve body 24*a* mounted on the upper wall of the canister body 10*a*, a diaphragm 24*b* for blocking communication between the canister body 10*a* and the purging passage 20, and a spring 24*c* for biasing the diaphragm 24*b* so as to cause the latter to be usually positioned at its closed position.

The diaphragm body 24*a* communicates with an intake passage 16*b* immediately upstream of the intake throttle valve 18 via a negative throttle pressure introducing passage 26. The negative throttle pressure introducing passage 26 has therein a solenoid valve 28 which is opened and closed in response to the turning ON and OFF thereof so as to establish or block communication between the canister 10 and the upstream intake passage 16*b*.

The purging passage 20 communicating with the downstream intake passage 16*a* passes through the side wall of the canister body 10*a* to be supported thereon. One end portion of the purging passage 20 opens to the upper portion of the canister body 10*a* and serves as a valve seat portion for the diaphragm 24*b*.

The diaphragm valve 24 is designed to open when negative pressure (negative throttle pressure), produced within the intake passage 16*b* immediately upstream of the intake throttle valve 18, becomes greater than a predetermined value, and to be closed when the negative pressure becomes less than the predetermined value or equal to an atmospheric pressure during a time in which the engine 7 is driven in the idling condition or is stopped, so that fuel-purging is performed only under a suitable fuel-purging condition.

The solenoid valve 28 is controlled so as to be open and closed corresponding to the open and closed conditions of the diaphragm valve 24, by means of a control unit 32.

The control unit 32 has a map defining a fuel-purging condition, in which fuel-purging is performed, and a fuel-purging prevented condition, in which fuel-purging is prevented, determined by, for example, engine revolution speed and negative pressure downstream of the intake throttle valve 18. On the basis of this map, the solenoid valve 28 is controlled to be open and closed in response to a command from the control unit 32. The solenoid valve 28 serves as means for determining whether or not the fuel-purging condition exists.

The control unit 32 is electrically connected to an oxygen sensor 34 for monitoring an air/fuel ratio in the exhaust gas from the engine 22 to produce an output signal representative of the air/fuel ratio, which will be hereinafter referred to as the "air/fuel ratio signal". The control unit 32 is also electrically connected to a temperature sensor 36 for monitoring temperature within the canister 10 to produce an output signal representative of the temperature, which will be hereinafter referred to as the "temperature signal". The air/fuel ratio signal and the temperature signal are input to the control unit 32.

The control unit 32 has discriminating means for receiving an ON-OFF signal of the solenoid valve 28, the air/fuel ratio signal and the temperature signal to determine whether or not the fuel-purging system is normal on the basis of the air/fuel ratio in the exhaust gas from the engine 22 and the temperature within the canister 10.

The operation of the fuel-purging system, according to the present invention, is described below.

In the fuel-purging condition, the solenoid valve 28 is caused to open in response to a command output from the control unit 32 on the basis of the aforementioned map. In this condition, the pressure within the intake passage 16*b* upstream of the intake throttle valve 18 becomes a negative pressure greater than a predetermined value (negative throttle pressure). This negative pressure is applied to the inside of the body 24*a* of the diaphragm valve 24 through the negative throttle pressure introducing passage 26, so that the diaphragm 24*b* moves upwards against the biasing force of the spring 24*c* so as to be separated from the valve seat portion 30 to establish communication between the purging passage 20 and the canister 10. As a result, the fuel collected within the canister 10 is introduced into the downstream intake passage 16*a* through the purging passage 20, and is supplied to the engine 22.

On the other hand, in the fuel-purging prevented condition, the solenoid valve 28 is caused to be closed in response to a command output from the control unit 32 on the basis of the aforementioned map. In this condition, the pressure within the intake passage 16*b* upstream of the intake throttle valve 18 becomes a negative pressure less than the predetermined value (negative throttle pressure), or equal to the atmospheric pressure. Therefore, the diaphragm 24*b* moves downwards due to the biasing force of the spring 24*c* so as to tightly come into contact with the valve seat portion 30 to block communication between the purging passage 20 and the canister 10. As a result, the introduction of the fuel collected within the canister 10 is prevented.

When fuel-purging is performed, at least one of the air/fuel ratio and the temperature within the canister 10 varies independently of the charge amount of the vaporized fuel within the canister 10, if the fuel-purging system is normal. On the other hand, if the fuel-purging system is abnormal, both of the air/fuel ratio and the temperature within the canister 10 do not vary.

When the vaporized fuel is adsorbed onto the adsorbent 14, such as an activated carbon, housed within the canister 10, the temperature of the adsorbent 14 increases. On the other hand, when fuel-purging is performed, the temperature of the adsorbent 14 decreases.

Therefore, if at least one of the air/fuel ratio and the temperature within the canister 10 varies while the fuel-purging is performed, it is determined by the discriminating means of the control unit 32 that the fuel-purging system is normal. On the other hand, if both of the air/fuel ratio and the temperature within the canister 10 do not vary while fuel-purging is performed, it is determined that the system is abnormal.

Figure 2:
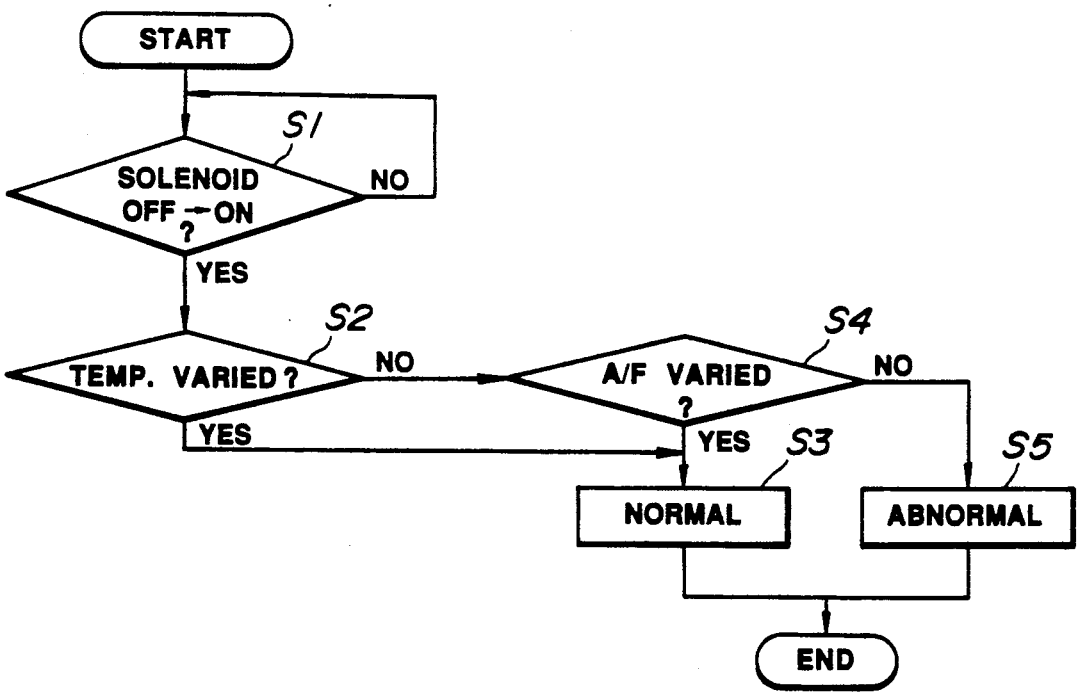
FIG. 2 is a flow chart showing a process for determining abnormality in the fuel-purging system of FIG. 2.

FIG. 2 shows a flow chart of a discriminating routine executed by the control unit 32 for determining whether or not the fuel-purging system is normal, according to the present invention.

In FIG. 2, at step 1, it is determined whether or not the solenoid valve 28 becomes ON. When it is ON, the routine goes to the step 2 in which it is determined whether or not the temperature within the canister 10 varies. When it varies, the routine goes to step 3 in which it is determined that the fuel-purging system is normal. On the other hand, if the temperature within the canister 10 does not vary, the routine goes to step 4 in which it is determined whether or not the air/fuel ratio varies. When it varies, the routine goes to step 3 in which it is determined that the fuel-purging system is normal. On the other hand, if the air/fuel ratio does not vary, the routine goes step 5 in which it is determined that the fuel-purging system is abnormal.

The relationships between the charging amount of the vaporized fuel within the canister 10, the fuel-purging condition or fuel-purging prevented condition (ON or OFF for the solenoid valve 28), the temperature within the canister 10, the air/fuel ratio, and the normal or abnormal condition of the fuel-purging system, are described in the Table.

TABLE

| NO. | STATE OF CANISTER | VARIATION OF SOLENOID | TEMPERATURE IN CANISTER | A/F RATIO | DIAGNOSIS OF PURGING SYSTEM |
|---|---|---|---|---|---|
| 1 | EMPTY | OFF → ON | NOT VARIED | NOT VARIED | ABNORMAL |
| 2 | EMPTY | OFF → ON | NOT VARIED | LEAN | NORMAL |
| 3 | MIDDLE CHARGE | OFF → ON | NOT VARIED | NOT VARIED | ABNORMAL |
| 4 | MIDDLE CHARGE | OFF → ON | SLIGHTLY DECREASE | NOT VARIED | NORMAL |
| 5 | FULL CHARGE | OFF → ON | NOT VARIED | NOT VARIED | ABNORMAL |
| 6 | FULL CHARGE | OFF → ON | DECREASE | VERY RICH | NORMAL |

In example No. 2 of the aforementioned Table, the air/fuel ratio becomes lean since air is supplied to the engine 22 by performing fuel-purging when the canister 10 is empty.

The fuel-purging system, according to the present invention, may be provided with a warning lamp, alarm means or the like for informing the driver that the fuel-purging system is abnormal.

As mentioned above, since the fuel-purging system, according to the present invention, may perform self-diagnosis on the basis of the temperature within the canister 10 and the air/fuel ratio, it is possible to accurately recognize whether or not the system is abnormal. In addition, it is possible to improve the reliability of the system and to quickly cope with abnormality of the system.

According to the aforementioned preferred embodiment of the invention, the solenoid valve 28 is controlled to be open and closed in response to a command output from the control unit 32 on the basis of the map defining the fuel-purging condition and the fuel-purging prevented condition, determined by, for example, the engine revolution speed and the negative pressure downstream of the intake throttle valve 18. On the basis of the turning ON or OFF of the solenoid valve 28, it is determined whether or not fuel-purging is performed. However, in order to detect the start of fuel-purging, the diaphragm valve 24 may be also provided with a sensor or the like for monitoring movement of the diaphragm 24*b* to detect the start of fuel-purging. Alternatively, the purging passage 20 may be provided with a proportional solenoid valve, the opening angle of which is controlled by a duty control on the basis of the engine driving condition or so forth. On the basis of the duty control signal supplied to the proportional solenoid valve, it is possible to detect the start of fuel-purging. In this case, fuel-purging is started when the duty control signal changes from 0 to another value.

What is claimed is:

1. A diagnosing system for a fuel-purging system used for a fuel processing system, said fuel purging system causing a fuel to be introduced from a fuel tank into a canister packed with an absorbent for absorbing the fuel thereon, and causing the fuel absorbed onto the absorbent to be introduced into an engine, said diagnosing system comprising:

first detecting means for detecting a fuel purging condition in which the fuel absorbed onto the absorbent of the canister is supplied to the engine, to produce a first signal representative of the fuel purging condition;

second detecting means for monitoring an air/fuel ratio in an exhaust gas from the engine to produce a second signal representative of the air/fuel ratio;

third detecting means for monitoring temperature in the canister to produce a third signal representative of the temperature in the canister; and discriminating means for determining abnormality of the fuel-purging system on the basis of the second and third signal values when the fuel-purging condition is detected.

2. A diagnosing system as set forth in claim 1, wherein said discriminating means determine abnormality of the fuel-purging system when both of the temperature in the canister and the air/fuel ratio are substantially constant while the fuel-purging condition is detected.

3. A diagnosing system as set forth in claim 1, wherein said purging system includes a first fluid passage for establishing a first fluid communication between the canister and an intake manifold downstream of a throttle valve, a second fluid passage for establishing a second fluid communication between the canister and the intake manifold upstream of the throttle valve, and a first valve for being selectively open and closed to establish and block the first and second fluid communications.

4. A diagnosing system as set forth in claim 3, wherein said first detecting means detects the fuel purging condition when the first valve is open.

5. A diagnosing system as set forth in claim 1, wherein said purging system includes a first fluid passage for establishing a first fluid communication between the canister and an intake manifold downstream of a throttle valve, a second fluid passage for establishing a second fluid communication between the canister and the intake manifold upstream of the throttle valve, a first valve for being selectively open and closed to establish and block the first and second fluid communications, and a second valve provided in the second fluid passage for being selectively open and closed to establish and block the second fluid communication, said first valve being open when a negative pressure greater than a predetermined value is produced in the intake manifold upstream of the throttle valve, and said second valve being turned on to be open synchronously with the first valve.

6. A diagnosing system as set forth in claim 5, wherein said first detecting means detects the fuel purging condition in response to turning ON of the second valve.

7. A fuel-purging system used for a fuel processing system for processing a fuel introduced into an engine, said fuel-purging system comprising:

a canister which communicates with a fuel tank, and into which a fuel is introduced from the fuel tank, said canister being packed with an absorbent for absorbing the fuel thereon;

a first fluid passage for establishing a first fluid communication between the canister and an intake manifold downstream of a throttle valve;

a second fluid passage for establishing a second fluid communication between the canister and the intake manifold upstream of the throttle valve;

a first valve for being selectively open and closed to establish and block the first and second fluid communications;

first detecting means for detecting a fuel purging condition in which the fuel absorbed onto the absorbent of the canister is supplied to the engine, to produce a first signal representative of the fuel purging condition;

second detecting means for monitoring an air/fuel ratio in an exhaust gas from the engine to produce a second signal representative of the air/fuel ratio;

third detecting means for monitoring temperature in the canister to produce a third signal representative of the temperature in the canister; and discriminating means for determining abnormality of the fuel-purging system on the basis of said second and third signal values when the fuel purging condition is detected by means of the first detecting means.

8. A fuel-purging system as set forth in claim 7, wherein said discriminating means determines abnormality of the fuel-purging system when both of the temperature in the canister and the air/fuel ratio are substantially constant while the fuel-purging condition is detected.

9. A fuel-purging system as set forth in claim 7, which further comprises a second valve provided in said second fluid passage for being selectively open and closed to establish and block said second fluid communication, and wherein said first valve is open when a negative pressure greater than a predetermined value is produced in said intake manifold upstream of said throttle valve, and said second valve is turned on to be open synchronously with said first valve.

10. A fuel-purging system as set forth in claim 9, wherein said first detecting means detects the fuel purging condition in response to turning ON of the second valve.

* * * * *